United States Patent [19]

Fuhrig

[11] Patent Number: 4,972,975

[45] Date of Patent: Nov. 27, 1990

[54] AUTOMATIC SPRAY CAN

[75] Inventor: Wolfgang Fuhrig, Wiesbaden, Fed. Rep. of Germany

[73] Assignees: OECO-Tech Entwicklung & Vertrieb von Verpackungssystemen GmbH, Fed. Rep. of Germany

[21] Appl. No.: 336,287

[22] Filed: Apr. 11, 1989

[30] Foreign Application Priority Data

Apr. 19, 1988 [DE] Fed. Rep. of Germany ..... 3812935

[51] Int. Cl.[5] ..... B67D 5/06

[52] U.S. Cl. ..... 222/182; 222/190; 222/394; 222/401; 222/333; 239/373; 239/351; 239/355

[58] Field of Search ..... 222/333, 182, 401, 394, 222/190; 239/373, 351, 355, 360

[56] References Cited

U.S. PATENT DOCUMENTS 1,875,729 9/1932 Herman ..... 239/351

3,406,017 10/1968 Carning ..... 222/333

*Primary Examiner*—H. Grant Skaggs

*Attorney, Agent, or Firm*—Biebel, French & Nauman

[57] ABSTRACT

An automatic spray can for spraying liquids is described, comprising a housing (1), in which an energy store (2), an electric motor (3) and a pump (6) for producing compressed air with a suction joint (7) and a pressure joint (8) are located, a product container (9) in engagement with the housing (1), with a spray head (14) including a spray nozzle (15) arranged at its top aperture (18), and an air feed pipe (13) between the pressure joint (8) of the pump (6) and the interior of the product container (9).

To make such a spray can smaller and lighter, and to enable a constant flow of spray jet with a uniform particle size to be produced with convenient operation, it is proposed according to the invention that the product container (9) be arranged as an extension of the housing (1), and the pump (6) be in the form of a vane type rotary pump, arranged at the upper end of the housing (1), with the air feed pipe (13) preferably extending over the whole length of the container.

20 Claims, 7 Drawing Sheets

AUTOMATIC SPRAY CAN

DESCRIPTION

The invention relates to an automatic spray can for spraying or foaming liquid products, comprising a housing, in which an energy supply or store means, an electric motor and a pump for producing compressed air with a suction joint and a pressure joint are located, a product container in engagement with the housing, with a spray head including a spray nozzle arranged at its top aperture, and a connection between the pressure joint of the pump and the interior of the product container, characterised in that the product container is arranged as an extension of the housing, and the pump is in the form of a vane type rotary pump, arranged at the upper end of the housing.

There are already many spray cans for spraying liquids, e.g. hairdressing products, cosmetics and medical products. Early spray cans were fitted with manual pumps. Later cans used propellant gases to save the final consumer the pumping work. Later the environmental damage caused by the propellant gases was realised, and manufacturers partly went back to manual pumps and partly onto electric ones.

An automatic spray can with the above-mentioned features is fitted with a diaphragm pump, and the oscillating movement of its diaphragm is maintained by the cam of an electric motor. The motor is supplied from a non-chargeable battery. The known spray cans are found to have considerable drawbacks, particularly with regard to distribution of particle size within the spray jet. Investigations have shown that different particle sizes are produced as a result of different pressures in the compressed air generated and different flow volumes of that air. There is no prior art pump which generates a spray jet with a constant flow, so the drawback of the uneven particle size in the jet had to be accepted.

In the known spray can with the electric motor and diaphragm pump it has been found that, when the pump is switched on, the air stream starts up slowly at low pressure and only reaches its maximum operating pressure at the maximum flow volume after a certain time. Similarly when the pump is switched off it is found that the spray jet does not stop immediately; it only declines slowly with the reduction in air volume and air pressure.

Switches and controls have already been considered therefore to find out how the diaphragm pump can be switched on and made to build up pressure but the spray nozzle can only be opened later; and conversely how the spray nozzle can be closed and the pump only switched off later. As a solution to this problem a manual pump has been developed, comprising a housing in the form of a handle and an adjacent product container spatially separate from the housing; the spray head of the product container being joined to the handle by a supporting arm. Thus the known spray can takes up a great deal of space and is inconvenient to take hold of and expensive to produce. It is expensive chiefly because, apart from having the battery in the lower part of the handle, the pump above it and the electric motor above the pump, two switches, valves and holding means with connecting nipples are provided to control the diaphragm pump, so that it immediately starts or stops at the final pressure and required flow volume when the valve is opened to generate the spray jet. The weight of the known spray also suffers from the many control devices and valve units.

The problem underlying the invention is therefore to develop an automatic spray can with the features mentioned above; it must be lightweight and low volume, must generate a spray jet of uniform particle size and with a constant flow, without aerosol propellants, and must be convenient to handle.

According to the invention the problem is solved, in that the product container is arranged as an extension of the housing, and the pump is in the form of a vane type rotary pump, arranged at the upper end of the housing. In contrast with prior art the inventor chooses a different arrangement and uses a different pump, thereby surprisingly obtaining a solution which is welcomed by the final consumer.

It should first be explained how the housing of the new spray can can "be in engagement with" the product container. The term implies a more or less loose arrangement of the product container in the housing and a fixing of the product container to the housing. In the invention the container should be regarded as being in engagement with the housing if there is a frictional or positive connection or a holding device produced e.g. by insertion or sliding. As explained below the container may be joined to the housing by clamping or screwing or with a snug fit; alternatively it may be inserted and carried in an appropriately shaped space in the housing, although the outer walls of the container need not fit snugly into the walls of the housing. The container may also project upwardly from the housing to various degrees or may be completely enclosed in it by a cap.

As compared with the known spray can with the housing forming the handle, the separate product container and the supporting arm joining the two parts, the invention provides a compact spray can with external dimensions substantially corresponding to the conventional spray cans on the market. These generally have a substantially cylindrical shape. But with the selection of suitable equipment in the invention it has surprisingly been found possible to keep the overall height of the new spray can including the container within reasonable limits, e.g. with a total height of 10 cm to 25 cm, preferably 13 cm to 20 cm, despite the presence of the compressed air units such as the energy store, electric motor and pump. The final consumer buying the new automatic spray can according to the invention will therefore regard it as a conventional spray can with propellants or other devices (manual pump or the like). He will then be all the more pleasantly surprised to find the compressed air units already in the can. This is achieved partly by arranging the product container as an extension of the housing. This feature implies that the compressed air units are arranged inside the housing, above or below the container, preferably below it, either with the compressed air units plus the container accommodated in a joint housing, or with all or part of the container projecting from the housing surrounding the compressed air units. In any case the housing is substantially cylindrical, and when the product container has been joined to it their central axes substantially coincide. In this way the new can may be made very small in volume and very conventient for the final consumer to handle.

The inventor further selected a vane type rotary pump, thereby obtaining the unexpected advantage of a constantly flowing spray jet, so that if the pump is correctly constructed and dimensioned a spray jet of uniform particle size can be generated.

The vane type rotary pump is based on a displacement action. A constantly rotating displacer at the suction side enlarges the pumping space and consequently produces suction of the fluid at the suction side, and reduces the pumping space with consequent delivery of the fluid at the compression side. The pump may be of the single shaft type with a rotating cylinder located eccentrically in the housing and with slides movable in slots mounted on it. The slides are applied to the wall of the housing by spring force or the like, so that rotation about the axis eccentric to the housing results in a periodic change of space and hence delivery of the flow medium. Vane type rotary pumps may also have two shafts, but these would work on the same principle.

The advantage of such a pump is that a constantly flowing spray jet is obtained, so compressed air can be produced without vibration or pulsation. These advantages mean that the pump is quieter than known diaphragm or other pumps, so the automatic spray can according to the invention is more pleasant to use.

Finally, if the rotary pump is located at the upper end of the housing, the connection to the product container can be drastically simplified. For example, the underside of the container may be fitted directly onto the pressure joint of the pump by means of suitable receiving devices, or an air feed pipe may be arranged in or adjacent the container, so that its length is substantially only equal to the height of the container. It will be appreciated that a spray can of this type is better, lighter and more pleasant to use if less tubes, pipes, connecting nipples, valves and the like have to be provided. This advantage is obtained if the pump is arranged at the upper end of the housing; the upper end being the end containing the compressed air units; "top" is understood as being the side where the container is attached. The compressed air units are always present and have a certain weight, even if the product container is missing or empty. So in a cylindrical spray can it is preferable to locate those units in the lower part of the housing or in the housing below the container. In the description the axis of the cylindrical housing is here taken to stand substantially vertically. The terms "at the top" and "at the bottom" are to be understood accordingly.

In a possible embodiment the vane type rotary pump may be fitted with a non return valve at the discharge side. This makes it possible e.g. for a connecting nipple on the product container, initially closed by a diaphragm, to be placed directly onto the pressure joint of the pump, so that the compressed air generated in the pump is let into the bottom of the container and immediately builds up pressure inside it. If the spray head is also closed at the top of the container and the protective or transport cap is taken off the spray nozzle, the pump will start spraying as soon as it is switched on.

There are other, alternative forms of spray can according to the invention and means for triggering the spray jet. For example, a different embodiment is characterised in that — as described at the beginning — the connection between the pump and the product container is an air feed pipe linking the pressure joint of the pump with the spray head and extending over the whole length of the container, and that a lifting pipe inside the container extends from the spray nozzle to the base of the container. In this embodiment there is no stop valve at the pump or the bottom of the product container; the pressure joint of the pump is first connected to the air feed pipe and the pipe is inserted in the spray head. So here the air pressure is in the spray head, pressing onto the surface of the liquid to be sprayed, in the container, and hence the lifting tube is required.

In this embodiment with the air feed pipe the overall construction of the new spray nozzle is compact, and small pipes or tubes only make a negligible difference to the weight. Of the whole space left for the product container, only a small amount is taken up by the feed pipe. Even if the feed pipe described is used therefore, the automatic spray can is light and relatively small, and can therefore utilise the advantages of the rotary pump and generate a spray jet of uniform particle size without a propellant, while still being convenient to handle.

In accordance with the invention it is advantageous for the housing at least partially to surround the container and preferably to be open at the top. It has already been mentioned above that the external shape of the housing is generally cylindrical. Here there is a possibility for the electric motor, preferably a DC motor, to be arranged adjacent the energy store, in the form of rechargeable accumulators, and below the pump in a special chamber which so to speak takes in the compressed air units. The chamber could be bounded by a base at the bottom and by an intermediate wall at the other side above the pump; however, the intermediate wall is not essential as the pump wall can be used instead. Outside the part containing the pressure units the housing may extend upwards in a cylindrical shape and surround the container more or less completely. In a preferred embodiment the housing rises to the upper edge of the container and is open at the top. Thus the container can be slid or lowered into the cylindrical space in the housing, and is then completely surrounded by it. In another embodiment the housing is shorter and only engages round a certain fraction of the container. If the accumulators are replaced by a supply cable, then the housing can be shortened further.

In accordance with the invention it is also desirable for the spray head to have a sealing cap which can be brought into engagement with the downstream end of the air feed pipe. The spray head is the component with both the spray nozzle and the top end wall of the product container. The top end wall may be in the form of a sealing cap as in the embodiment described here. It may be joined to the container by snap on or screw connections. It is essential for it to be liquid tight. Connecting nipples may be provided at the sealing cap, or other devices for joining pipes such as the air feed pipe or for supporting the lifting tube. In this embodiment the cap can be brought into engagement with the downstream end of the air feed pipe. Thus the pipe can be opened or closed by appropriate means which will be described below. This has the advantage that the pump can be switched on, yet the spray jet may not be generated until the cap has been operated. Operation of this type may be desirable for some applications or for certain target groups of consumers.

In this connection it is particularly advantageous for the sealing cap to have a sealing member which can be placed on the end of the air feed pipe. This member closes the downstream end of the pipe and may be operated manually or non-manually, in various ways, from various directions and in various parts of the spray head. So if the pump is switched on and the feed pipe impinged on with compressed air, the spray jet can only be formed — by forcing the liquid out through the rising tube — when the sealing member opens the end of the pipe so that the stream of compressed air can enter the spray head.

The sealing member provided in this connection may be a peg or plug or alternatively a ring or collar.

In a special embodiment, which will be explained in detail below with reference to the drawings, the sealing cap is made of resilient plastics. It is screwed onto the top central aperture of the container, in such a way that the air feed pipe arranged centrally in the container comes into engagement with and seals the lower annular edge of a collar projecting downwardly from the central part of the cap towards the feed pipe. The lower outer end of the collar is placed on and seals the end of the feed pipe. The inside of the collar has a plurality of ribs, so that when the final consumer and user presses the top of the sealing cap, the liquid tight fit between the sealing ring and the end of the air feed pipe is terminated and — in a first embodiment — the downstream end of the feed pipe is thus opened. When the operating part of the cap is depressed, the sealing ring is instantly lifted off the feed pipe, and compressed air is now inside the spray head at the level of the liquid in the product container. The conditions for the formation of the spray jet now exist.

In another form of the invention the seal member may again be a plug or ring and may be placed on and seal the downstream end of the air feed pipe from the inner end of the sealing cap. But in contrast with the embodiment where the user presses onto the operating portion at the top and releases the sealing fit by means of the ribs, here the sealing ring is lifted off the feed pipe through turning the cap by means of screw thread, thereby again enabling the compressed air to flow out into the spray head. The difference between this embodiment and the one previously described is that the last-mentioned cap remains in the open position after being turned, whereas in the first construction the hole only remains open so long as the user is pressing onto the operating part of the cap at the top. When the cap has been released the end of the feed pipe closes immediately.

Yet another embodiment of the invention is characterised in that the spray head contains a hole some distance away from the spray nozzle. The arrangement here is that when the pump has been switched on, compressed air enters the spray head immediately, but because the head contains a hole it escapes through it, so a spray jet cannot form yet. If the user closes the hole in the head with a finger, the compressed air acts on the liquid in the container, guiding the liquid product up the lifting tube into the spray nozzle, and spraying begins at once. This construction provides a very simple form of volume control. The spray jet will in fact vary in size according to how completely the user closes the hole with his finger. If he substantially closes it the jet will be large and vice versa.

In this embodiment the spray head with the hole and spray nozzle may have both the lifting tube and a connecting nipple for the air feed pipe. If the feed pipe is preferably tubular, it may be pulled off the nipple on the spray head when the product container has been emptied, and the spray head may be unscrewed from the container and pulled out of it, so that the new, full container can be inserted and expensive parts need not be discarded with the old empty one. The consumer can reuse the spray head with the nozzle, lifting tube and connecting nipple for the new container.

In another embodiment of the invention the hole in the spray head may be sealed by an operating closure. This may be a displaceable cap, seated so as to slide over a cylindrical attachment and keeping the hole in the spray head closed in one extreme position and open in another. When the pump is switched on the spray jet is accordingly generated or not generated.

The connection already mentioned between the housing and the product container may be such that the bottom of the container is joined detachably to an edge portion of the housing adjacent the pump. In this embodiment the housing may be substantially restricted to an enclosure for the compressed air units and may only include quite a small edge portion above the pump, into which the base and adjacent edge of the container is inserted and fixed, e.g. by screwing, with a snug fit or with a snap connection, so that the housing and container act as an integral unit. In this embodiment the air feed pipe may run centrally within the container or outside it into the spray head.

It is advantageous for the air feed pipe to be arranged outside the container and inside the housing. Where there is a cylindrical housing and a cylindtrical container — as already mentioned — the air feed pipe may either be taken centrally within the container, so that it extends inside the container and inside the housing from the pump to the spray head. In the alternative embodiment described here the cylindrical periphery of the container may contain an elongated depression or groove with the air feed pipe — as seen in plan — being guided inside the circular space but outside the container. If the housing is long enough substantially to surround the container then the pipe will be inside the housing and outside the container. Obviously this condition may be met to a greater or lesser degree if the housing only partly surrounds the container.

The electric motor must of course be provided with a switch, particularly as in case of the energy store the energy contained in the store must be used economically. In this connection it is desirable for the motor switch to project from the end of the housing. If it projects e.g. from the bottom of the housing, then provisions can be made for the pump to be operated immediately when the spray can is lifted off whatever surface it is on. An adjustable locking device may of course be provided and may prevent the switch from projecting unless the locking device is pushed aside.

If the electric switch for the motor projects from the top of the housing, then the user can take hold of the spray can with one hand, e.g. the right hand, and switch on the motor and pump immediately with one finger, e.g. the index finger.

It is advantageous for the energy store means to be in the form of an accumulator and to be connected to a charging plug which is mounted on the base plate of the housing and which can be connected to receiving contacts of a charging station. Compared with non-rechargeable batteries the accumulator has the advantage of recharging, which is utilised in known manner in many pieces of electrical equipment, particularly manual equipment. The arrangement of the pump at the top of the housing next to the container has the advantage that the electric motor can be arranged at the bottom, with the charging plug on the base plate of the housing. It may, for example, project from it as a peg.

It is further desirable, according to the invention, for the base plate of the housing to be offset inwardly from the lower edge of the cylindrical housing, and for the charging station to have a corresponding annular groove to receive the lower edge, and a frustoconical centering guide above it. The centering guide makes the electrical contacts meet, i.e. the charging plug and the receiving contacts, since the lower edge of the housing is forced into the annular groove. As the base plate of the housing is also set back from its lower edge, a cavity is formed inside the lower edge of the housing. This may well accommodate the charging plug — whether or not it is peg shaped — and/or the switch or other devices, without them projecting beyond the total contour of the spray can.

The invention also provides for the receiving contacts in the charging station to be equipped with movable dust protection means. For example, slots may be punched out of a plastic disc in a star shape, forming flaps which fold down when a pin is inserted and swing back into the dust excluding position when the pin is pulled out. Bristle like closures may also be provided to protect from dust, as in the hand brake slot of a motor vehicle.

A special embodiment of the invention comprises a charging station with its main plane substantially in the centre of an approximately cylindrical space, with the said annular grooves located outside this supporting plate and the centering guide fixed above it. The receiving contacts of the charging station are located centrally below the supporting plate, which contains a hole aligned above them. The hole is closed by a slide, which covers the central aperture for the electrical contacts below it. If the lower edge of the housing is placed in the annular groove, then mechanical slides acting through tension members cause the resiliently pretensioned slide to be pulled out of its protective position, so that the hole is opened and the contacts exposed.

The automatic spray can according to the invention has a vane type rotary pump with an external diameter of about 40 mm to 45 mm, preferably 42 mm, and a height of 15 mm to 20 mm, preferably 18 mm. It is particularly advantageous for the weight of the housing, including the compressed air units, i.e. without the product container either full or empty, to be from 300 g to 400 g and preferably 350 g. It will be appreciated that a spray can with such a weight is very attractive to the final consumer and will be pleasant to use.

Other advantages, features and applications of the invention will become apparent from the following description, which refers to the accompanying drawings. In the drawings.

Figure 4:
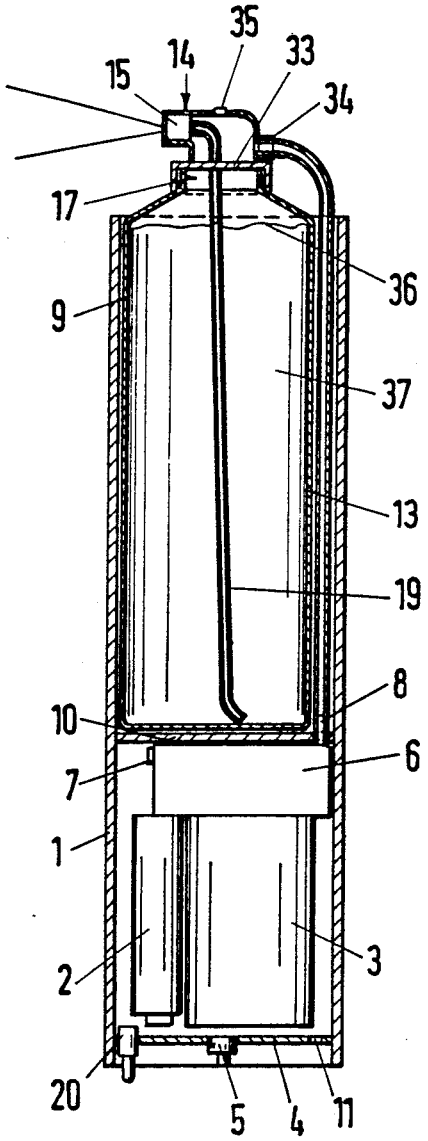
FIG. 4 shows a different embodiment of the spray can, with the air feed pipe arranged outside the product container and inside the housing, without a sealing cap but with an aperture in the spray head.
Figure 4A:
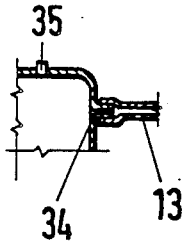
FIG. 4A is a fragmentary view of a detail at the top right hand corner of the spray head in FIG. 4, showing the connecting nipple of the spray head and the hole in it.
Figure 4B:
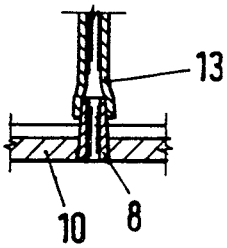

FIG. 4B gives a detail from FIG. 4 in the centre of the housing, in the region of the pressure joint of the pump.

Figure 5:
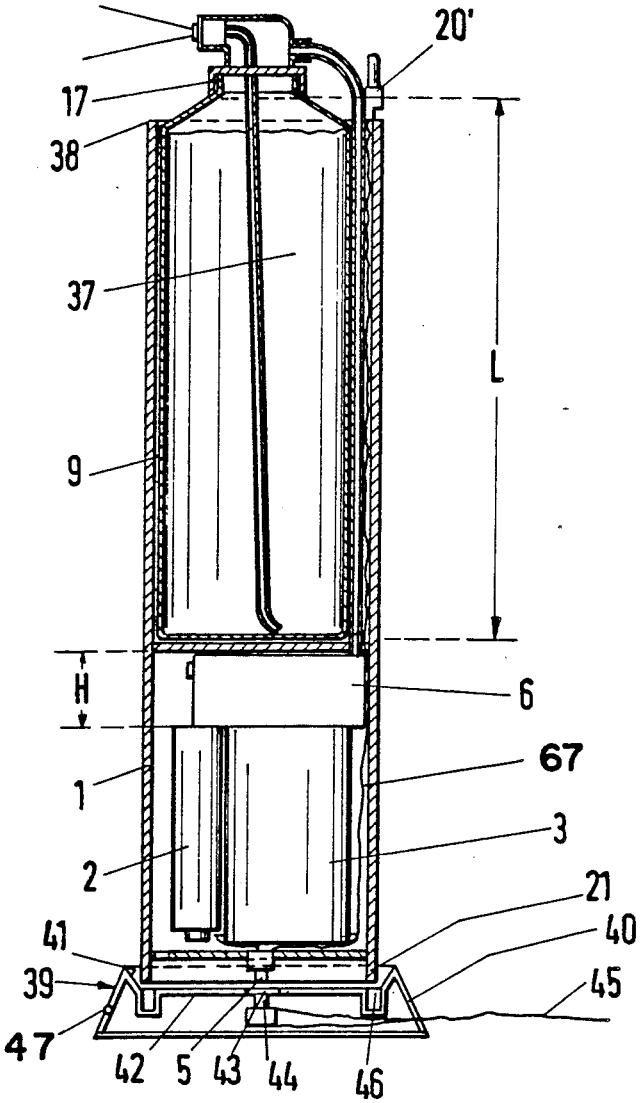

FIG. 5 shows another different embodiment of the spray can, where the spray head is similar to that in FIG. 4, though without the hole, but where the switch of the electric motor is brought out at the upper end of the housing, while the lower end of the housing is shown on a charging station, some distance from it in the pulled out position.

Figure 6:
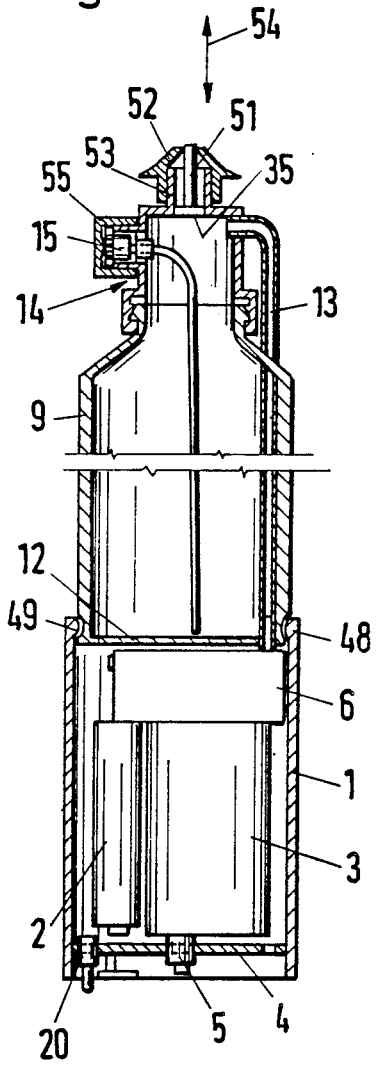

FIG. 6 represents a different embodiment of the invention, where the housing is shorter and is joined to the lower edge of the product container by a snap fastener, and where the spray head of the product container is provided with an operating closure at the top.

Figure 6B:
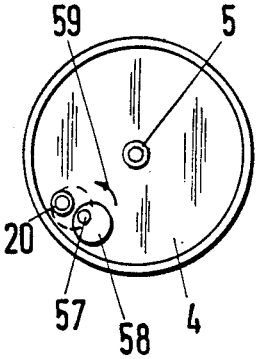
Figure 6A:
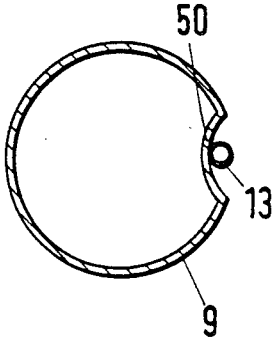

FIG. 6A is a sectional view through the product container in the region where it is cut off, but without the lifting tube.

FIG. 6B is a plan view of the FIG. 6 housing from below.

Figure 7:
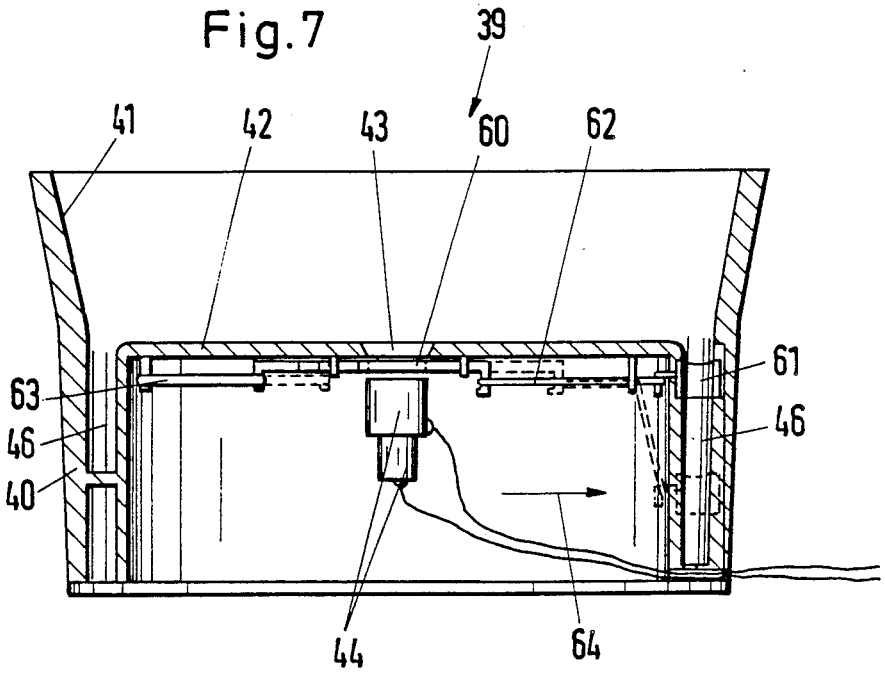
Figure 7A:
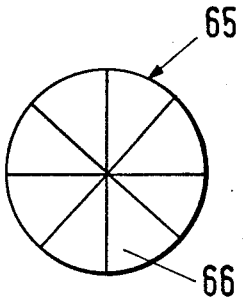

FIG. 7 is a larger scale cross-sectional view of another embodiment of the charging station, with a receiving contact and a dust excluding slide and FIG. 7A shows a different embodiment of the dust excluding means.

The automatic spray can according to the invention comprises a housing 1 into which accumulators are clamped to act as energy store means 2. Their connection 2' is provided by wiring (not shown), e.g. by a bar, which is obvious to a person skilled in the art so need not be described here. Only the electric motor 3 is illustrated, diagramatically. This is attached to the base plate 4 of the housing 1 in an unspecified manner, e.g. by screws. The motor 3 is connected electrically to the charging plug 5. A vane type rotary pump 6 is also screwed into the housing. Its suction joint can be seen at 7 and its pressure joint at 8, projecting upwardly to the product container 9.

In the FIG. 4 embodiment the housing 1 has an intermediate base 10 in the centre as well as the base plate 4 at the bottom. An admission port 11 in the base plate 4 supplies fresh air to the chamber inside the part of the housing 1 containing the compressed air units 2, 3, 6, so that fresh air can be supplied to the suction joint 7.

Figure 1:
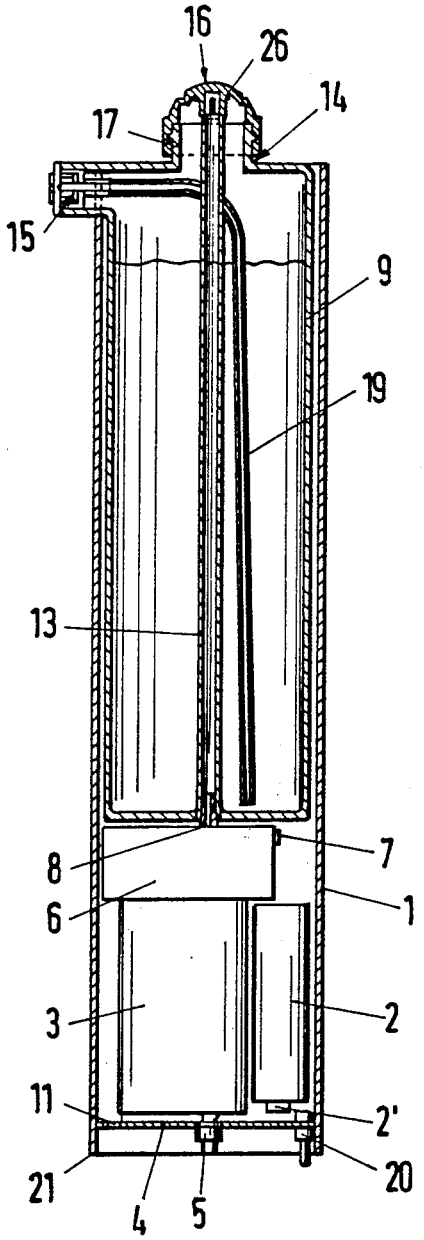
FIG. 1 is a cross-sectional view through a first embodiment of the spray can, with a sealing cap and a centrally arranged air feed pipe.
Figure 1A:
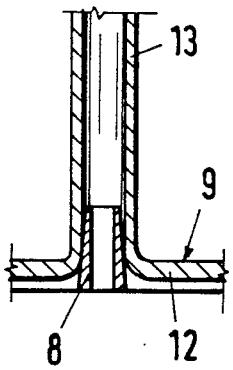
FIG. 1A shows a detail from FIG. 1, namely the pressure joint of the pump in engagement with the upstream end of the product container with the air feed pipe.

The product container 9 is made of plastics. In the FIG. 1 embodiment it has a base 12 containing a hole connected to the air feed pipe 13, which extends over the whole length of the product container 9 and ends in the spray head 14 at the top. The spray head 14 may be mounted detachably at the top of the container 9. It is the part comprising both the spray nozzle, shown generally at 15, and the top member, which in FIG. 1 is the sealing cap 16. The housing 1 is open at the top and the container 9 also has an aperture 18 in its upper portion, in the neck 17. The spray nozzle 15 is joined to a lifting tube 19 extending to the base 12 of the product container 9.

The electric switch 20 can finally be explained with reference to FIG. 1. It is fixed to the base plate 4, which is offset inwardly from the lower edge 21 of the housing 1. The electric wiring is not shown. It should merely be mentioned that the switch 20 projects downwardly beyond the lower edge 21 of the housing 1 as a spigot, so that when the spray can is lifted off the supporting surface a switching function takes place, e.g. the motor 3 may be switched on to operate the pump 6.

Figure 2A:
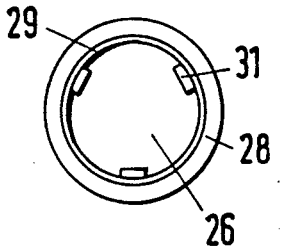
FIG. 2A is the same section through the sealing ring taken along the line A—A in FIG. 2 but without the feed pipe.
Figure 2:
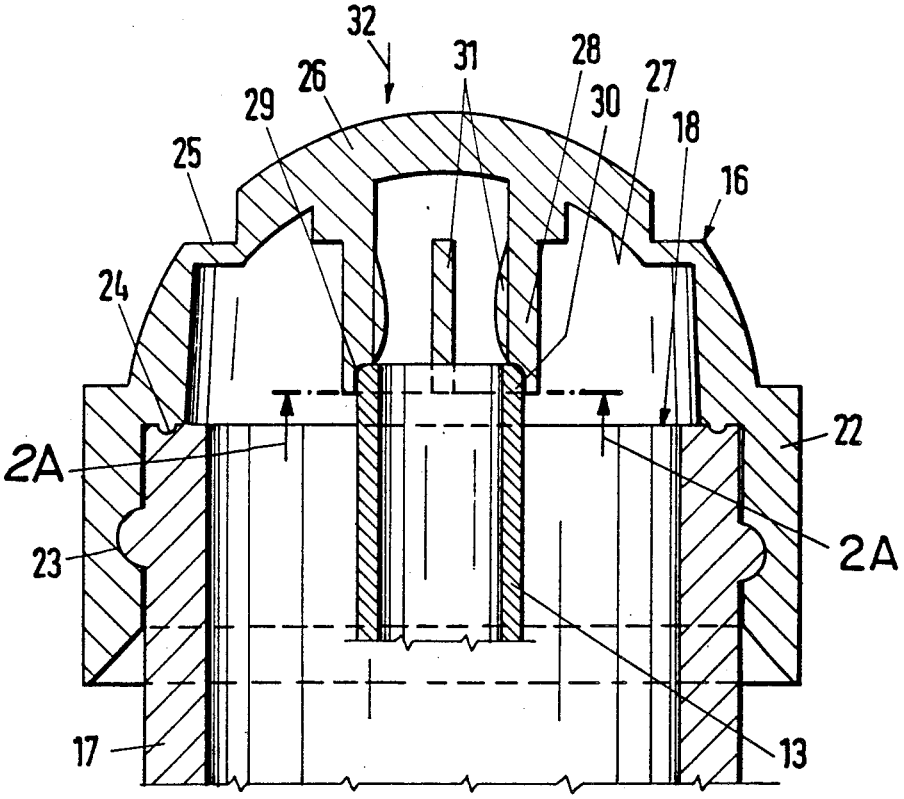
FIG. 2 shows the sealing cap on the spray head at the top of FIG. 1.

In FIG. 2 the aperture 18 in the spray head 14 is shown as the aperture of the neck 17 of the product container 9, for in the FIG. 1 embodiment the neck 17 is part of the spray head shown generally at 14. The aperture 18 is closed by a sealing cap shown generally at 16. The cap 16 has a concave part at the top, and a cylindrical portion 22 with internal screw thread 23 and a sealing ring 24 adjoins it in a downward direction. It will be seen from FIG. 2, like FIGS. 3 and 3A, that the neck 17 of the product container 9 has corresponding external screw thread, so the sealing cap 16 can be screwed on tight (or alternatively can be clamped on the neck 17 by a bead, through snapping it onto the neck 17). Within the upper, concave part of the cap 16 there is an operating portion 26 above an annular weakened portion 25. The user can press the operating portion from outside, and the weakened portion 25 will enable it to move down onto the cylindrical, fixing part 22 of the cap 16. While FIG. 2 illustrates the inoperative, sealing position of the cap 16, FIG. 3 shows how the weakened portion 25 with its associated folds has been bent by being operated and pressed down.

A collar 28 of cylindrical shape extends downwards internally from the surface 27 of the operating portion 26, far enough to make an annular sealing surface 29 rest on and seal the downstream end 30 of the air feed pipe 13. If one looks at the collar 28, acting as a sealing member, from below as in FIG. 2A, one is looking at the operating portion 26 centrally from below. On the outside one can see the annular sealing surface 29 surrounding that portion, and the cylindrical walls 28, externally carrying three ribs 31 which are spread evenly around the inner periphery. The ribs are bent inwards towards the interior of the sealing member 28 like paunches, their purpose being to make the lower edge of the paunch like curve start immediately behind the annular sealing surface 29, so that when the operating portion 26 is pressed down in the direction of the arrow 32 the collar 28 will be expanded by the ribs 31.

Figure 3:
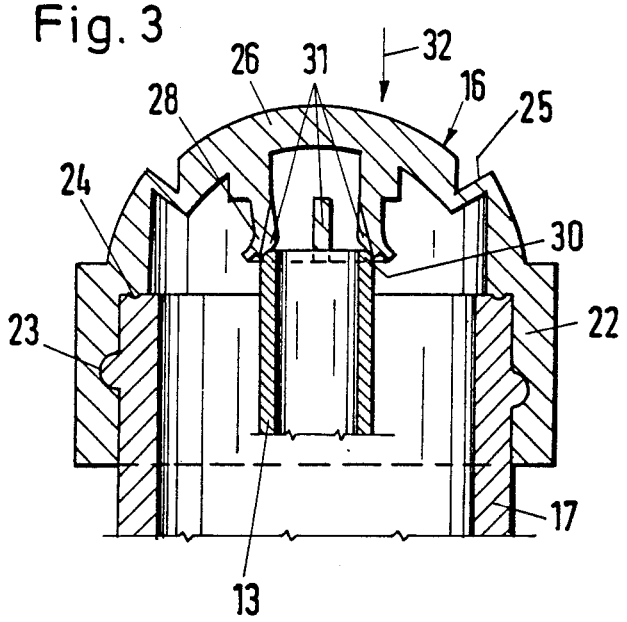
FIG. 3 shows the same as FIG. 2, but on a smaller scale and in the working position, after pressure has been applied to the operating portion and the aperture partly exposed.

This state can best be explained by referring to FIG. 3. Whereas the cap 16, which is preferably made of LDPE material, is in the transporting or inoperative position in FIG. 2, FIG. 3 shows the so-called working position, when the user has pressed the operating portion 26 down in the direction of the arrow 32, onto the product container 9 and air feed pipe 13. With the aid of the annular weakened folding line 25, the hole sealing collar 28 can move down in the direction of the arrow 32, making the ribs 31 abut the end 30 of the air feed pipe 13, with the result that the ribs 31 lift the annular sealing surface 29 of the member 28 off the matching end 30 of the feed pipe 13, and lift the surface 29 off the end 30 of the feed pipe with the cylindrical collar 28 stretched (sic). This creates an opening, so that compressed air in the feed pipe 13 can immediately flow out of the space inside the sealing member 28 or annular collar 28, into the space below the sealing cap 16 and into the neck 17 of the container 9. This is the working position. If the user relieves the pressure on the operating portion 26 with his finger, then the restoring force of the LDPE material immediately raises the portion 26 to the position shown in FIG. 2, so that the ribs 31 are disengaged from the end 30 of the tube 13, and the seal can function again along the surface 29.

Figure 3A:
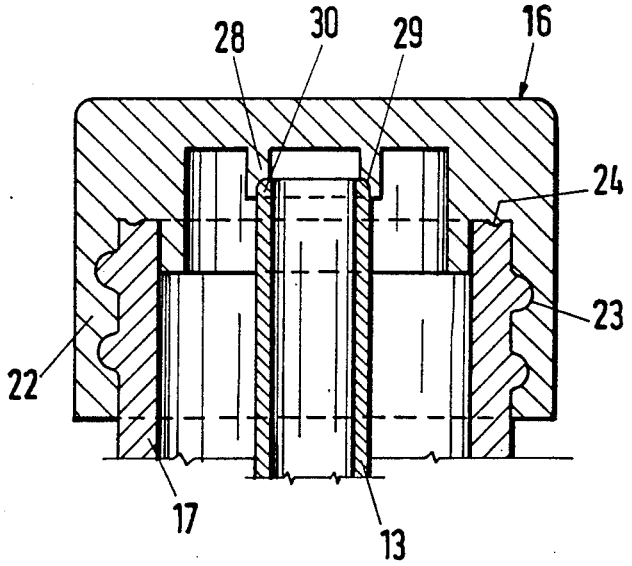
FIG. 3A shows another embodiment of a sealing cap, which is screwed on the product container by means of thread.

There is a similar action in the other embodiment in FIG. 3A. Here one can see the closure member 28 with the annular sealing surface 29, which forms a seal with the downstream end 30 of the feed pipe 13 when the cap 16 is screwed onto the neck 17 of the container 9. But if the cap is screwed a bit further (ein Stück weit), the sealing collar 28 is lifted off the end 30 of the tube 13, and a passage is again provided for the compressed air in the tube 13 as described above.

Another different embodiment is illustrated in FIG. 4. There is an intermediate wall 10 in the housing 1, and the pressure joint 8 of the vane type rotary pump 6 is located in the outside of the wall 10, near the periphery of the housing wall 1. The feed pipe 13 is pushed onto the pressure joint 8 and stays there preferentially in the manner shown in FIG. 4B. The container 9 may e.g. have a quite normal screw closure at the top, perhaps in the form of the screw portion 33. The screw closure is removed before the new, full product container is inserted, and the spray head shown generally at 14 is screwed on instead, with its screw portion 33 engaging the neck 17 of the container. The air feed pipe 13, which may project e.g. from the top edge, is then pushed over the connecting nipple 34 of the spray head 14 as shown in FIG. 4A, thereby anchoring it in an airtight manner. The special feature of the spray head 14 in FIG. 4 is the provision of a hole 35, which the user can simply close to a greater or lesser extent with his or her finger.

The FIG. 4 embodiment operates as follows. When the spray can has been lifted off the supporting surface (not shown) with the housing 1, the switch 20 is operated, the motor 3 and pump 6 switched on, and compressed air immediately passes through the feed pipe 13 up into the spray head 14. The air first blows out of the hole 35 so that no spray jet is generated. But if the consumer or user of the can closes the hole 35 to a greater or less degree with a finger of the hand holding the housing 1, the compressed air will be more or less above the surface 36 of the fluid product 37 and will force it through the lifting tube 19 into the nozzle 15, thereby forming a larger or smaller spray jet, according to how much the hole 35 is closed by the user's finger. This gives an opportunity for volume control.

It is obvious that, when the product container 9 is transported, either the screw cap described above will be used or the spray head 14 shown in FIG. 4 will be left on the container. In this case the spray nozzle 15, the hole 35 acting as an "operating aperture" and the connecting nipple 34 will naturally each be covered with a transport cap. However, it is preferable for the spray head not to be discarded with the empty product container but rather to be screwed onto the container 9 when the transport seals have been removed.

FIG. 5 shows another, similar embodiment but without any hole in the spray head. The electric switch 20' is transposed from the bottom adjacent the motor 3 to the top 38 of the housing 1 by means of a cable 67. For this reason the reference used here for this switch is 20' with an apostrophe. The length L of the product container 9 can be seen here, and its upper end has been taken as the mean dimension where the neck 17 is attached.

This embodiment is worked by the user operating the switch 20' and thereby switching on the pump 6; as the pressure is immediately applied to the fluid product 37 the spray jet is formed.

A further embodiment can be seen in FIG. 5, namely a charging station 39. This comprises a frustoconical or cylindrical outer wall 40 with a centering guide 41 at its upper end. This leads down in a funnel shape into the centre of the charging station 39, where there is an intermediate wall 42 in the form of a supporting plate containing a central hole 43. Contacts 44 to receive a coaxial cable 45 leading to an electrical charger are arranged below the hole 43. There is an annular groove 46 between the guide 41 and the plate 42, its diameter corresponding to the lower edge 21 of the housing 1.

If the user puts the housing into the charging station 39 after using the spray can, the edge 21 will automatically be placed in the annular groove 46 by the centering guide 41, and the charging plug 5 will pass through the hole 43 in the plate 42 down into the receiving contacts 44. If the coaxial cable 45 is connected, the accumulator 2 can thus be charged, with the spray can standing on the charging station 39, unused. The charging control light 47 is on when the charging current is flowing.

Alternatively the accumulator 2 may be charged inductively, i.e. without contacts and without a transformer.

Another slightly modified embodiment is shown in FIG. 6. Here the housing 1 of the spray can is shorter and substantially comprises only the accumulator 2, motor 3 and pump 6. The pressure joint 8 of the pump is similar to that shown and described in connection with FIG. 4. The housing 1 has an edge portion 48 with a rebound closure 49 at the level of the pressure joint 8. The product container 9 has an appropriate receiving groove in the region of its base 12 so that, although the central and upper parts of the container are not held by the housing 1, its base is joined detachably to the edge portion 48 of the housing adjacent the pump 6.

Whereas in FIGS. 4 and 5 the air feed pipe 13 is arranged outside the container 9 and inside the housing 1, in FIG. 6 it is still outside the container 9, as can be seen in a cross-sectional view in FIG. 6A, where the container 9 is cut in FIG. 6. But here the feed pipe 13 is not inside the housing 1 in the upper region, because the housing is not provided in the central and upper part of the container 9. However, the container has a matching groove 50 extending over substantially its whole length L, and the feed pipe 13 is accommodated in it. Thus the cross-section of the housing and of the whole spray can is still circular, rather than having the feed pipe 13 externally adjacent the cylinder, which might be a nuisance.

The spray head 14 in FIG. 6 again has the hole 35 as an operating aperture, but here ribs extending through the aperture are provided so that they hold a central rod 51. The rod is surrounded by an operating closure 52 in an airtight manner, particularly by the tongue shaped ends at the top. Since the cylindrical closure 52 is held by means of the collar 53 at the spray head 14, it can be moved relative to the central peg 51 in the direction of the double arrow 54. In this way the hole 35 is connected to the outer atmosphere or kept shut. So in contrast with the FIG. 4 embodiment a finger is not needed to keep the hole 35 closed. Pressure exerted on the closure 52 in the direction of the downward arrow 54 in FIG. 6 is sufficient to reach the closed state shown in that figure. If the pump 6 is then actuated by switching on the electric switch 20, and if the transport cap 55 shown here is taken off the spray nozzle 15, generation of the spray jet starts immediately. If the consumer pulls up the operating closure 52 in the upward direction of the arrow 54 while the pump 6 is running, then the compressed air arriving in the spray head 14 through the pipe 13 is vented and the spray jet stops immediately.

The user may not wish to have the can switched on when the housing 1 is lifted off the supporting surface, e.g. for transport purposes. In that case he can move the blocking lever 58 in FIG. 6B, which is in the form of a disc rotatable about a spindle 57, in the direction of the arrow 59 from the continuous line position to the broken line position, thereby bringing the switch 20 into the secure transport position.

FIG. 7 shows a different embodiment of the charging station 39, although identical components carry identical references. In addition to the supporting plate 42 with the central hole 43 and the receiving contacts 44 below it, a dust excluder in the form of a sliding cover 60 is illustrated here. An operating element 61 is provided at several places in the annular groove 46, spread evenly round the periphery. With the aid of tension members 62 it pulls away the plate cover below the hole 43 in the direction of the arrow 64, against the force of a rubber band 63, so that the broken line position is then reached.

Another dust cover is shown, finally, in FIG. 7A. It is similar to the sliding cover 60, either above or below the hole 43, in the form of a plastic disc 65 which is cut in a star shape to form collapsing lips or flaps 66. When the charging plug 5 is pulled out the lips or flaps return to the dust excluder position shown in FIG. 7A.

Instead of accumulators a supply cable can be used as energy supply means, as commonly many electric equipments are provided with a cable connection. Thereby a direct external electrical power supply is obtained for the electric motor. However, for other embodiments solar cells are conceived, with the electrical energy of which the motor is being fed. Alternatively, the energy can be supplied to the pump drive also in the form of pressurized air.

I claim:

1. An automatic spray can for spraying or foaming liquid products, comprising a housing, having a storage means for an energy supply, an electric motor and a compressor for producing compressed air with a suction joint and a pressure joint, a product container in engagement with the housing, with a spray head including a spray nozzle arranged at a top aperture of the container, and a connection between the pressure joint of the compressor and the interior of the product container, characterized in that the product container is arranged within an upper extension of the housing, and the compressor is in the form of a vane type rotary compressor arranged at one end of the housing, the compressor pressurizing the product container through the aperture thereby forcing the liquid through the spray nozzle.

2. The spray can of claim 1, characterized in that the connection between said compressor and said product container is an air feed pipe linking the pressure joint of said pump with said spray head and extending over the whole length (L) of said container, and that a lifting pipe inside said container extends from said spray nozzle to the base of said container.

3. The spray can of claim 2, characterized in that said housing at least partially surrounds said container and is open at the top.

4. The spray can of claim 3, characterized in that said spray head has a sealing cap which can be brought into engagement with the downstream end of said air feed pipe.

5. The spray can of claim 4, characterized in that said sealing cap has a sealing member which can be placed on said downstream end.

6. The spray can of claim 3, characterized in that said spray head contains a hole which is some distance away from said spray nozzle.

7. The spray can of claim 6, characterized in that said hole can be closed with an operating closure.

8. The spray can of claim 7, characterized in that the base of said product container is joined detachably to an edge portion of said housing adjacent said pipe.

9. The spray can of claim 8, characterized in that said air feed pipe is located outside said container and inside said housing.

10. The spray can of claim 9, characterized in that said motor has an electric switch arranged so that it projects from the one end of said housing.

11. The spray can of claim 10, characterized in that said energy supply is in the form of an accumulator and is connected to a charging plug, which is mounted on a base plate of said housing and which can be connected to receiving contacts of a charging station.

12. The spray can of claim 11, characterized in that said base plate is offset internally from the lower edge of said housing, and said charging station has a corresponding annular groove to receive said lower edge, and a frustoconical centering guide arranged above said groove.

13. The spray can of claim 12, characterized in that said receiving contacts are provided with movable dust protection means.

14. The spray can of claim 13, characterized in that said compressor has an external diameter between between 40 mm and 45 mm, and a height (H) between 15 mm and 20 mm.

15. The spray can of claim 14, characterized in that the weight of said housing, including compressed air units within said housing, is between 300 g and 400 g.

16. The spray can of claim 1, characterized in that said energy supply comprises a supply cable connected to said electric motor and extending outwardly of said housing.

17. An automatic spray can for spraying or foaming a liquid therefrom comprises:

a housing means;

an electric motor encased within the housing means;

an air compressor operatively connected to the motor, and encased within the housing means, the compressor having an air intake port and an exhaust port;

a liquid storage means enclosed within the housing means, the liquid storage means having an upper aperture which is adjacent to the top of the liquid storage means;

an air pressure supply tube being connected at a first end with the exhaust port of the compressor, and at a second end, with the upper aperture of the liquid storage means; and a nozzle means sealingly mounted to the liquid storage means and over the aperture, the nozzle means comprising a spray nozzle and a liquid supply tube connected thereto, the liquid supply tube extending into the liquid storage means; whereby when the compressor is operated by the motor, the air exhausts through the aperture, via the air pressure supply tube, and forces a liquid in the liquid storage means through the liquid supply tube and through the nozzle.

18. The automatic spray can of claim 17 wherein the air pressure supply tube is formed integrally with the liquid storage means, the tube being formed as a feed pipe extending upwardly and integrally with the base of the liquid storage means.

19. The automatic spray can of claim 17, further comprising an energy storage means located within the housing and proximate to the motor, where the motor, compressor and energy storage means are located beneath the liquid storage means.

20. The automatic spray can of claim 17 wherein the housing means comprises an upper housing portion and a lower housing portion, where the upper housing portion forms the liquid storage means, and the lower housing portion houses the motor and air compressor.

* * * * *